US007526973B2

(12) United States Patent
Katoh

(10) Patent No.: US 7,526,973 B2
(45) Date of Patent: May 5, 2009

(54) STARTER WITH INTERMEDIATE GEAR

(75) Inventor: Masahiro Katoh, Chiryu (JP)

(73) Assignee: Denso Corporation, Kariya (JP)

( * ) Notice: Subject to any disclaimer, the term of this patent is extended or adjusted under 35 U.S.C. 154(b) by 177 days.

(21) Appl. No.: 11/808,895

(22) Filed: Jun. 13, 2007

(65) Prior Publication Data

US 2007/0295163 A1 Dec. 27, 2007

(30) Foreign Application Priority Data

Jun. 13, 2006 (JP) ..... 2006-163394

(51) Int. Cl.
*F02N 1/00* (2006.01)

(52) U.S. Cl. ..... 74/7 R; 74/7 E; 123/179.1

(58) Field of Classification Search ..... 74/7 R, 74/7 E; 123/179.1
See application file for complete search history.

(56) References Cited

U.S. PATENT DOCUMENTS 5,165,293 A 11/1992 Kittaka et al.
5,258,674 A * 11/1993 Sakamoto et al. ..... 310/83
5,265,485 A * 11/1993 Sakamoto et al. ..... 74/7 E
5,277,075 A * 1/1994 Sakamoto et al. ..... 74/7 R
5,706,699 A * 1/1998 Moribayashi ..... 74/7 A
6,097,119 A * 8/2000 Kuragaki et al. ..... 310/89
6,647,812 B2 11/2003 Nito et al.
7,302,869 B2 * 12/2007 Kamei et al. ..... 74/6
2006/0123935 A1 6/2006 Miyake
2006/0219032 A1 10/2006 Miyake
2007/0107544 A1 5/2007 Hirabayashi

FOREIGN PATENT DOCUMENTS

JP B2 8-6664 1/1996
JP A 2002-180937 6/2002
JP A 2006-169983 6/2006
JP A 2006-274874 10/2006

* cited by examiner

*Primary Examiner*—David M Fenstermacher
(74) *Attorney, Agent, or Firm*—Oliff & Berridge, PLC

(57) ABSTRACT

A starter with an intermediate gear includes a front bearing portion formed with a mounting hole for supporting the front end portion of an intermediate shaft and a retaining hole located at a position offset from a center of the mounting hole in a radial direction in such a manner as to intersect the mounting hole, and a screw member threaded into the retaining hole and remaining in engagement with the intermediate shaft to retain the intermediate shaft in a fixed position against removal from housing.

7 Claims, 6 Drawing Sheets

STARTER WITH INTERMEDIATE GEAR

CROSS REFERENCE TO RELATED APPLICATION

The present application is based on and claims priority from Japanese Patent Application No. 2006-163394, filed Jun. 13, 2006, the content of which is incorporated herein by reference.

BACKGROUND OF THE INVENTION

1. Field of the Invention

The present invention relates generally to starters for internal combustion engines, and more particularly to a starter having an intermediate gear adapted to remain in meshing engagement with a pinion gear at all times and operative to be brought into meshing engagement with a ring gear of an engine to perform startup of the engine.

2. Description of the Related Art

Starters having an intermediate gear of the type described are known as disclosed for example in Japanese Patent Application Publication JP 2002-180937 A1 (corresponding to U.S. Pat. No. 6,647,812). The disclosed starter includes an intermediate shaft supported on a housing at opposite ends thereof, an intermediate gear rotatably mounted on the intermediate shaft and axially movable thereon, and a pinion gear held in meshing engagement with the intermediate gear at all times. During startup of an engine, the intermediate gear is axially moved together with the pinion gear into meshing engagement with a ring gear of the engine.

To avoid unintentional removal from the housing, the intermediate shaft is retained to the housing by using a circlip or snap ring that is fitted in a groove on the intermediate shaft, or a pin that is press-fitted in the housing. However, due to the use of a snap ring, the first-mentioned retaining method renders the intermediate shaft and the housing complicated in construction and difficult to manufacture, leading to an increase in the manufacturing cost. The second-mentioned retaining method is also problematic in that due to the use of the pin press-fitted in the housing, detachment of the intermediate shaft from the housing is practically impossible and, hence, maintenance involving replacement of the gears inside the housing cannot be performed.

SUMMARY OF THE INVENTION

It is accordingly an object of the present invention to provide a starter with an intermediate gear that is excellent in assembling capability and maintenance ability.

According to the invention, there is provided a starter with an intermediate shaft, comprising: a pinion shaft rotatable in receipt of a rotational force from a motor; a pinion gear slidably supported on the pinion shaft and axially movable thereon; an intermediate shaft disposed in parallel to the pinion shaft; an intermediate gear rotatably supported on the intermediate shaft and axially movable thereon, the intermediate gear being adapted to remain in meshing engagement with the pinion gear at all times; a housing which supports both end portions of the intermediate shaft; and an engagement member which retains the intermediate shaft in position against removal from the housing. The intermediate gear is axially movable together with the pinion gear into meshing engagement with a ring gear of an engine to transfer the rotational force from the pinion gear to the ring gear via the intermediate gear for starting up the engine. The housing has a first bearing portion which supports one end portion of the intermediate shaft and a second bearing portion which supports the other end portion of the intermediate shaft. One of the first bearing portion and the second bearing portion has a mounting hole formed therein for insertion of the intermediate shaft, and a retaining hole formed in the one bearing portion at a position offset from a center of the mounting hole in a radial direction so as to intersect the mounting hole. The engagement member is a screw member threaded into the retaining hole of the one bearing portion, the screw member being in engagement with the intermediate shaft to retain the intermediate shaft to the housing against removal therefrom.

With this arrangement, by merely inserting the screw member into the retaining hole, the screw member comes in engagement with the intermediate shaft so that the intermediate shaft is retained to the housing against removal therefrom. Removing the screw member from the retaining hole allows the intermediate shaft to be removed from the housing, which will ensure easy maintenance of the starter including replacement of the gears.

In one preferred form of the invention, the housing has a mounting surface at which the housing is mounted to the engine, and the first and second bearing portions of the housing have a semicircular arc shape projecting from the mounting surface of the housing toward the engine. The one bearing portion formed with the retaining hole has a screw seating surface in abutment with a bearing surface of a head of the screw member to bear a tightening force of the screw member. The screw seating surface is formed at a position such that the head of the screw member does not project from an outer periphery of the semicircular arc-shaped one bearing portion. With this arrangement, the head of the screw member does not interfere with an engine part.

Preferably, the retaining hole has a first side located near the center of the mounting hole and a second side diametrically opposite to the first side and located remotely from the center of the mounting hole. The screw seating surface is provided to extend on the second side of the retaining hole, and the first side of the retaining hole is free from the screw seating surface and passes straight through the one bearing portion from the outer periphery to an inner periphery of the one bearing portion.

If the screw seating surface were provided also on the first side of the retaining hole (namely, if the screw seating surface were provided to extend along the entire circumference of the retaining hole), the one bearing portion would have a thin part formed between the screw seating surface and the inner periphery of the one bearing portion on the first side of the retaining hole. The thus formed thin part is likely to crack or become ruptured due to stress concentration occurring when the screw member is tightened or the starter is activated. According to the invention, however, since the first side of the retaining hole is free from the screw seating surface and passes straight through the one bearing portion from the outer periphery to the inner periphery of the one bearing portion, it is possible for the one bearing portion to avoid the formation of a thin part, which may otherwise cause cracking or rupturing due to stress concentration. With this structure, the durability of the starter is improved.

Preferably, the screw member has an externally threaded portion at one end thereof, an enlarged head at the other end thereof, and a round shank extending between the externally threaded portion and the head. The round shank is in engagement with the intermediate shaft to retain the intermediate shaft to the housing against removal therefrom. Since the round shank is free from a screw thread, it can offer a stable engagement between itself and the intermediate shaft and, hence, is able to perform a retaining function in a reliable manner to prevent the intermediate shaft from displacing off the housing.

It is preferable that the retaining hole is offset from the center of the mounting hole in a direction opposite to the direction of a reaction force, which is applied from the ring gear to the intermediate shaft when the intermediate gear drives the ring gear. With this arrangement, the screw member as being threaded in the retaining hole is not subjected to the reaction force exerted from the ring gear when the starter is activated. Thus, the screw member has a higher degree of durability.

Preferably, the first bearing portion is located adjacent to the motor and the second bearing portion is located remotely from the motor. The mounting hole formed in the first bearing portion is a blind hole while the mounting hole formed in the second bearing portion is a through-hole. With this arrangement, since the intermediate shaft can be inserted into the through-hole from a front side of the housing for assembly, no hindrance occurs to the motor when assembling the intermediate shaft to the housing, making it possible to assemble the intermediate shaft and the intermediate gear even after the motor has been assembled to the housing. This will result in improvement in assembling capability.

It is preferable that the retaining hole is formed in the second bearing portion, and the intermediate shaft has a shoulder portion formed on an outer circumferential surface thereof at a position supported by the second bearing portion, the shoulder portion being engaged by the screw member for prevention of the intermediate shaft against removal from the housing. With this arrangement, using the through-hole in the second bearing portion, an orientation (or an angular position in a circumferential direction) of the intermediate shaft can be confirmed from the front side of the housing. Therefore, the screw member can be inserted into the retaining hole under a condition where the intermediate shaft is positioned with respect to the circumferential direction. Thus, the screw member can readily perform a function to retain the intermediate shaft in a fixed position against axial and rotational movements relative to the housing.

DETAILED DESCRIPTION OF THE PREFERRED EMBODIMENT

Figure 1:
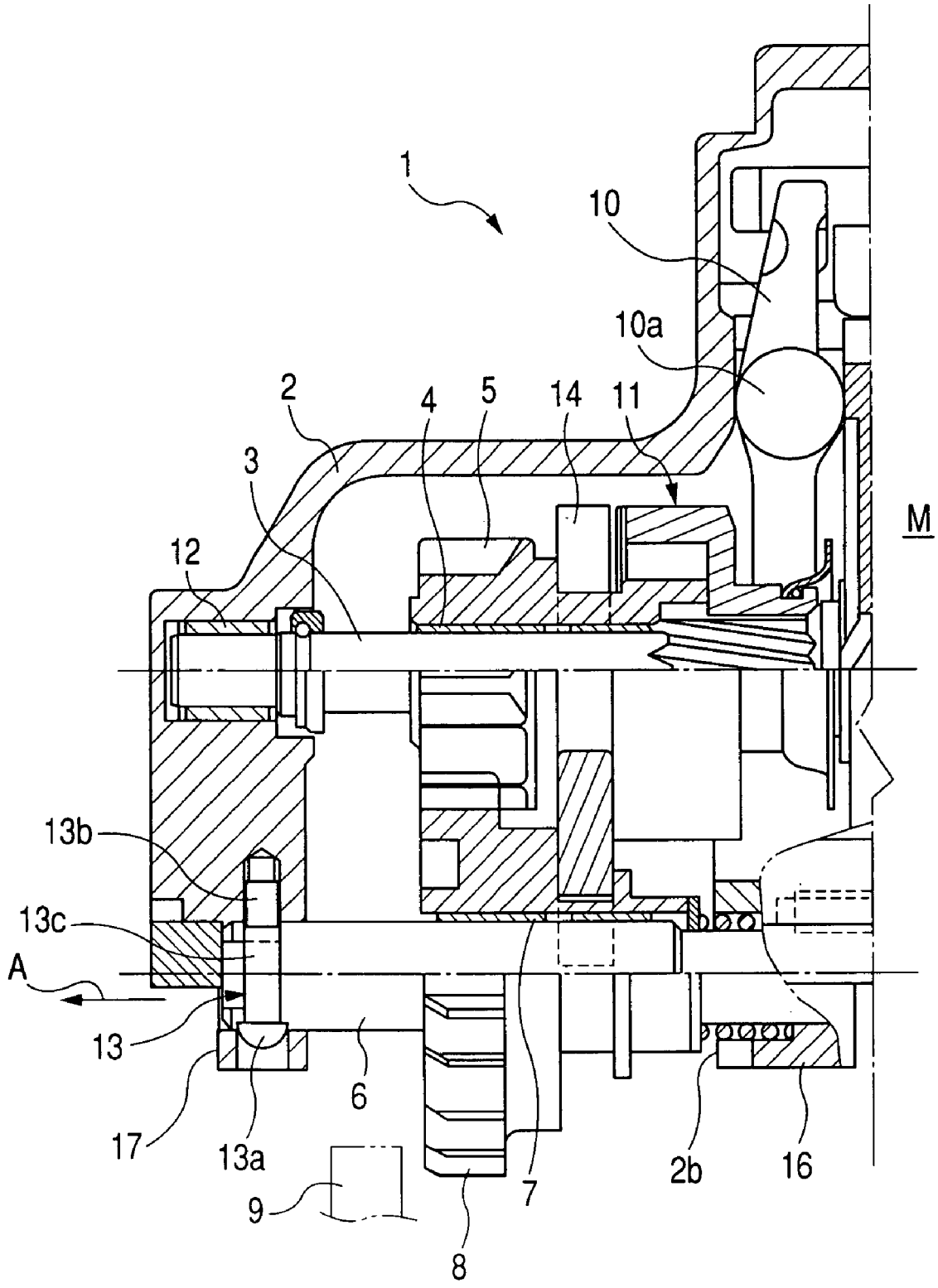
FIG. 1 is a cross-sectional view of a portion of a starter according to a preferred embodiment of the present invention.
Figure 2:
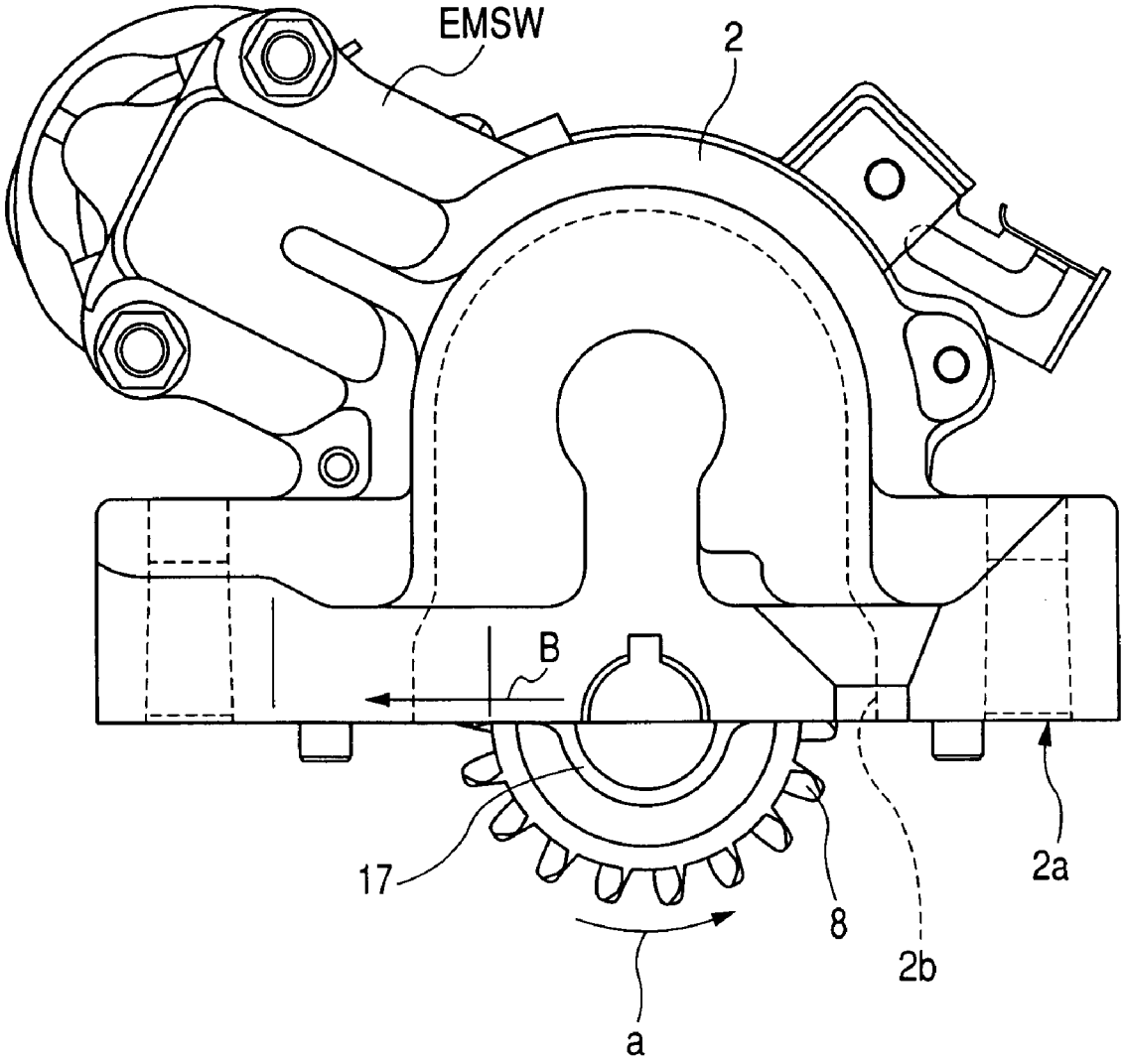
FIG. 2 is a front elevational view of the starter.
Figure 3:
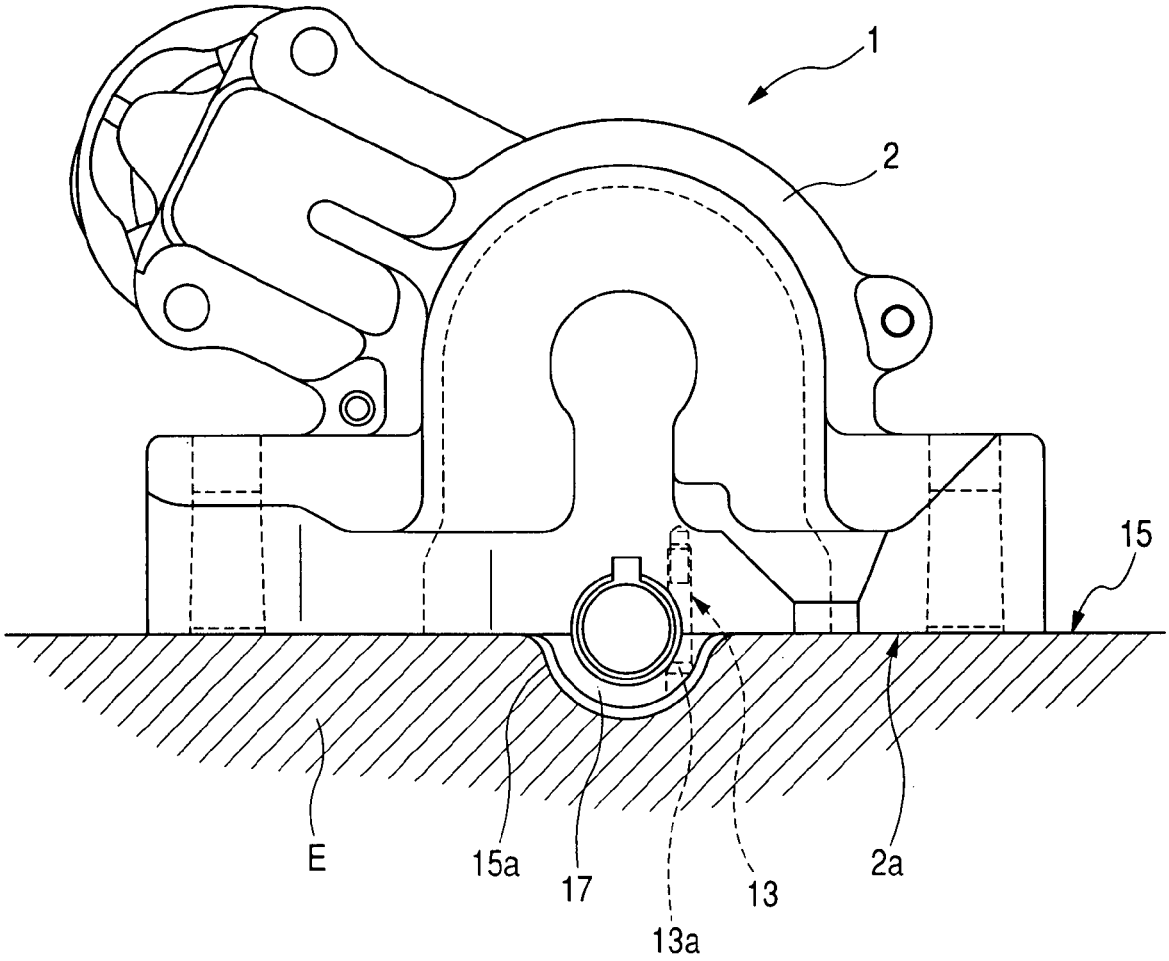
FIG. 3 is a view similar to FIG. 3, but showing the starter as it is mounted to a starter loading surface of an engine.

Referring now to the drawings and FIG. 1 in particular, there is shown in cross section a starter 1 with an intermediate gear according to a preferred embodiment of the present invention. The starter 1 generally comprises a motor M for generating a rotational force, an electromagnetic switch EMSW (FIG. 2) operable to open and close main contacts of a power distribution circuit (hereinafter referred to as "motor circuit") for the motor M, a housing 2 to which the motor M and the electromagnetic switch EMSW are mounted, a pinion shaft 3 driven by the motor M for rotation, a pinion gear 5 fitted with an outer periphery of the pinion shaft 3 via a bearing 4, an intermediate shaft 6 disposed in parallel to the pinion shaft 3, and an intermediate gear 8 fitted with an outer periphery of the intermediate shaft 6 via a bearing 7. The intermediate gear 8 is axially movable together with the pinion gear 5 in a direction (leftward in FIG. 1) opposite to the motor M to be brought into meshing engagement with a ring gear 9 of an engine E (FIG. 3).

The motor. M may preferably include a well-known direct current electric motor that is connected to the main contacts of the motor circuit. The motor M has an armature (not shown) that is supplied with electric power from an on-vehicle battery (not shown) to generate a rotational force upon closing operation of the electromagnetic switch EMSW.

The electromagnetic switch EMSW includes an excitation coil (not shown), which forms an electromagnet when conducted with electric power from the on-vehicle battery, and a plunger (not shown), which is movable under the effect of an attracting force of the electromagnet to perform opening and closing operations of the main contacts while causing a shift lever 10 to shift a clutch 11 in an axial direction. The shift lever 10 is pivotally connected to the housing 2 for undergoing pivotal movement about a pivot point 10*a* to transfer movement of the plunger to the clutch 11.

The pinion shaft 3 is coaxially aligned with an axis of the armature of the motor M and has one end (left end in FIG. 1) rotatably supported by a front portion of the housing 2 by means of a bearing 12. The pinion shaft 3 also has the other end (right end in FIG. 1) connected to an armature shaft of the motor M via a reduction gear unit such as a planetary gear reduction unit (not shown). The pinion shaft 3 may be directly coupled to the armature shaft without intervening the reduction gear unit.

The pinion gear 5 allows the rotation of the pinion shaft 3 to be transferred through the clutch 11 and is movable on the pinion shaft 3 to undergo reciprocation along the pinion shaft 3 together with the clutch 11.

The clutch 11 is coupled to the outer periphery of the pinion shaft 3 through helical spline engagement and takes the form of a one-way clutch that is operative to transfer the rotation of the pinion shaft 3 to the pinion gear 5 while interrupting power transfer between the pinion gear 5 and the pinion shaft 3 so as to preclude the rotation of the engine E from being transferred to the pinion shaft 3 when the rotation of the engine E is transferred from the ring gear 9 to the pinion gear 3, that is, when a rotational speed of the pinion gear 5 exceeds a rotational speed of the pinion shaft 3.

The intermediate shaft 6 has both end portions supported by the housing 2, with one end portion (left end in FIG. 1) of the intermediate shaft 6 being retained to the housing 2 against removal from, and rotation relative to, the housing 2 by means of a screw member (engagement member) 13.

The intermediate gear 8 is rotatably supported on the intermediate shaft 6 in meshing engagement with the pinion gear 5 at all times. The intermediate gear 8 is coupled to a connecting portion between the pinion gear 5 and the clutch 11 via an anchor member 14. With this coupling, the intermediate gear 5 is enabled to axially shift on the intermediate shaft 6 in meshing engagement with the pinion gear 5 when the pinion gear 5 moves along the pinion shaft 3 integrally with the clutch 11.

Figure 4:
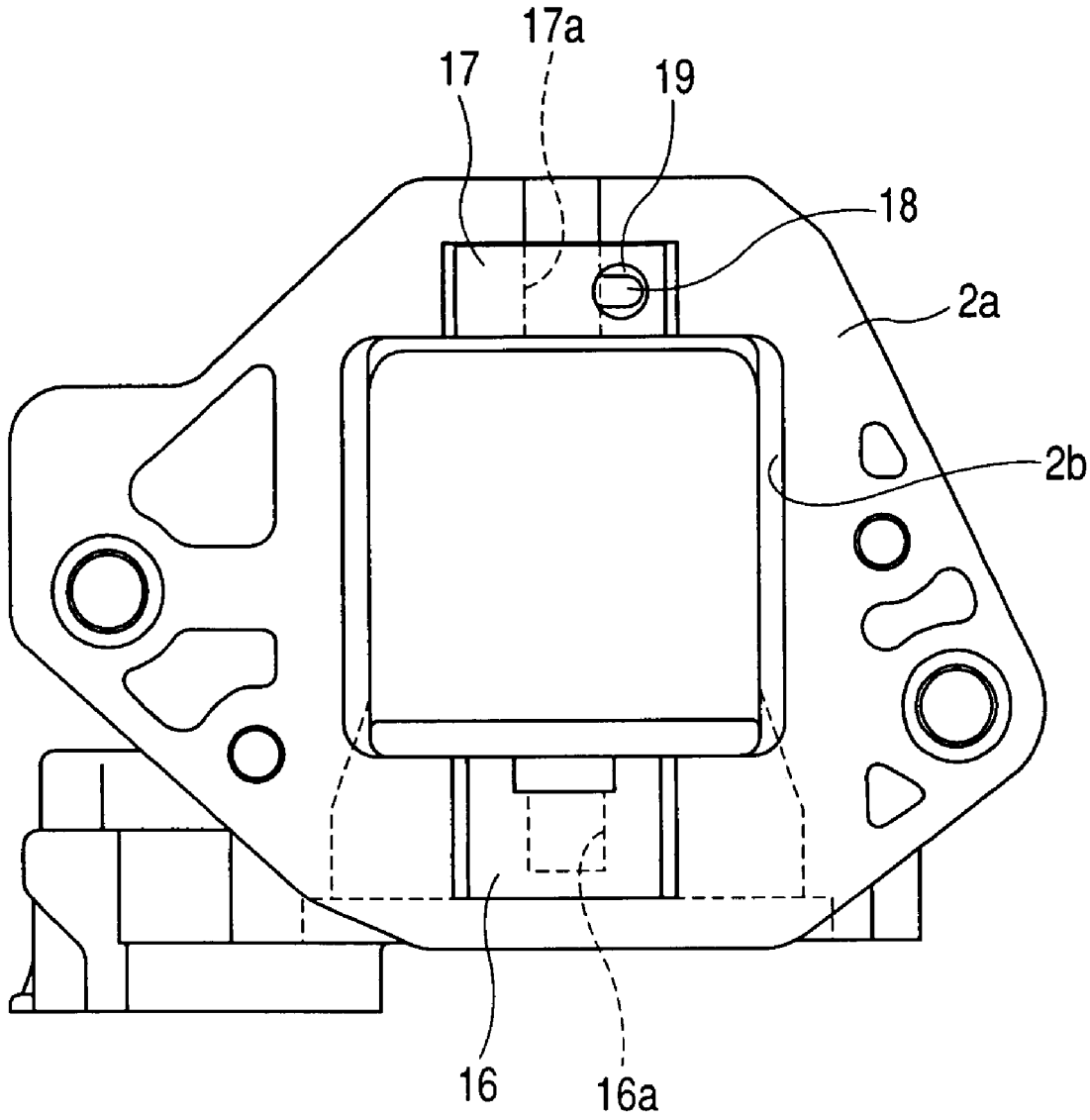
FIG. 4 is a bottom plan view of the starter, showing a mounting surface of a housing of the starter at which the starter is mounted to the engine.

As shown in FIG. 3, the housing 2 has a mounting surface 2*a* placed on a starter loading surface 15 of an engine part, such as engine block or mission case, with a gasket (not shown) disposed therebetween. The housing 2 is fixedly mounted to the engine E by means of bolts (not shown). The mounting surface 2*a* is formed with a rectangular opening portion 2*b*, through which a substantially and radially half part of the intermediate gear 8 is exposed to the outside of the housing 2 from the mounting surface 2*a* to allow the intermediate gear 8 to be brought into meshing engagement with the ring gear 9 (FIG. 1) of the engine E, as shown in FIGS. 2 and 4

The housing 2 further has first and second axially spaced bearing portions 16 and 17 extending downward in parallel to each other as viewed in FIG. 1, by which the intermediate shaft 6 is supported at both axial ends of the opening portion 2*b*.

The first bearing portion 16 is disposed on a motor side (lower side in FIG. 4) of the opening portion 2*b* located adjacent to the motor M (FIG. 1) and has a mounting hole 16*a* formed therein for insertion of one end portion (right end portion in FIG. 1) of the intermediate shaft 6 located adjacent to the motor M. The mounting hole 16*a* is a blind hole, which does not pass completely through the first bearing portion 16. The blind hole 16*a* has an open end facing in a direction opposite to the motor M and a closed end located close to the motor M. The first bearing portion 16 is provided at a rear end of the housing 2 located adjacent to the motor M and, hence, will be hereinafter referred to as "rear bearing portion".

The second bearing portion 17 is disposed on an anti-motor side (upper side in FIG. 4) of the opening portion 2*b* located remotely from the motor M (FIG. 1) and has a mounting hole 17*a* formed therein for insertion of the other end portion (left end portion in FIG. 1) of the intermediate shaft 6 located remotely from the motor M. The mounting hole 17*a* is a through-hole, which passes completely through the second bearing portion 17. The first second bearing portion 16 is provided at a front end of the housing 2 located remotely from the motor M and, hence, will be hereinafter referred to as "front bearing portion".

The front and rear bearing portions 16 and 17 have a semicircular arc shape projecting from the mounting surface 2*a* of the housing 2 toward the engine E (FIG. 3) and support the intermediate shaft 6 such that a substantially and radially half part of the intermediate gear 8 is exposed to the outside of the housing 2 from the mounting surface 2*a* for meshing engagement with the ring gear 9 (FIG. 1) of the engine E. The starter bearing surface 15 of the engine E has two recessed portions 15*a* (one being shown in FIG. 3) of a semicircular arc shape that accommodate the rear and front bearing portions 16, 18, respectively, therein.

Next, a structure provided for retaining the intermediate shaft 6 in a fixed position against removal from, and rotation relative to, the housing 2 will be described below.

Figure 5:
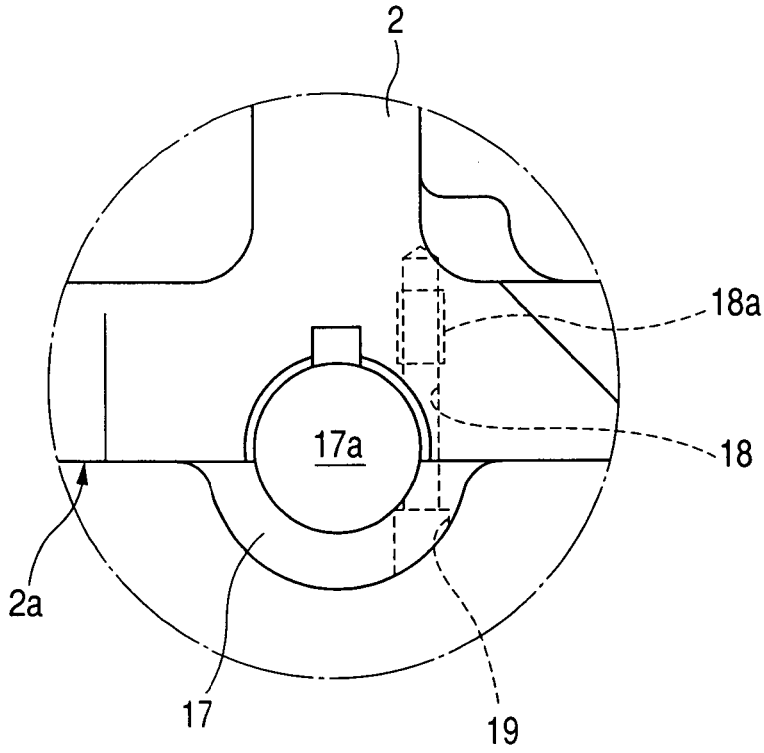
FIG. 5 is an enlarged view, with parts cut-away for clarity, of a portion of FIG. 3 including a bearing portion on a front side of the housing.

As shown in FIG. 5, the front bearing portion 17 has a retaining hole 18 formed therein at a position offset from a center of the mounting hole 17*a* in a radial direction (rightward direction in FIG. 5) parallel to the mounting surface 2*a* of the housing 2, so as to extend in a direction perpendicular to the mounting surface 2*a* in such a manner as to intersect the mounting hole 17*a*. The retaining hole 18 has a rear end formed with an internally threaded portion 18*a*. The retaining hole 18 is offset from the center of the mounting hole 17*a* in a direction opposite to the direction of a reaction force (indicated by the arrow B shown in FIG. 2) applied from the ring gear 9 to the intermediate shaft 6 when the intermediate gear 8 is in driving mesh with the ring gear 9.

Figure 6:
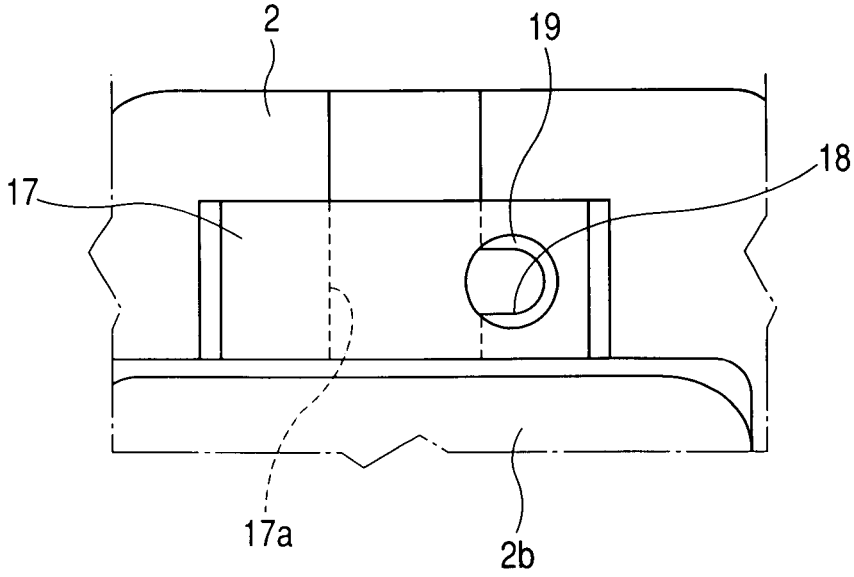
FIG. 6 is a bottom view of FIG. 5, showing a screw seating surface formed in the bearing portion.
Figure 7:
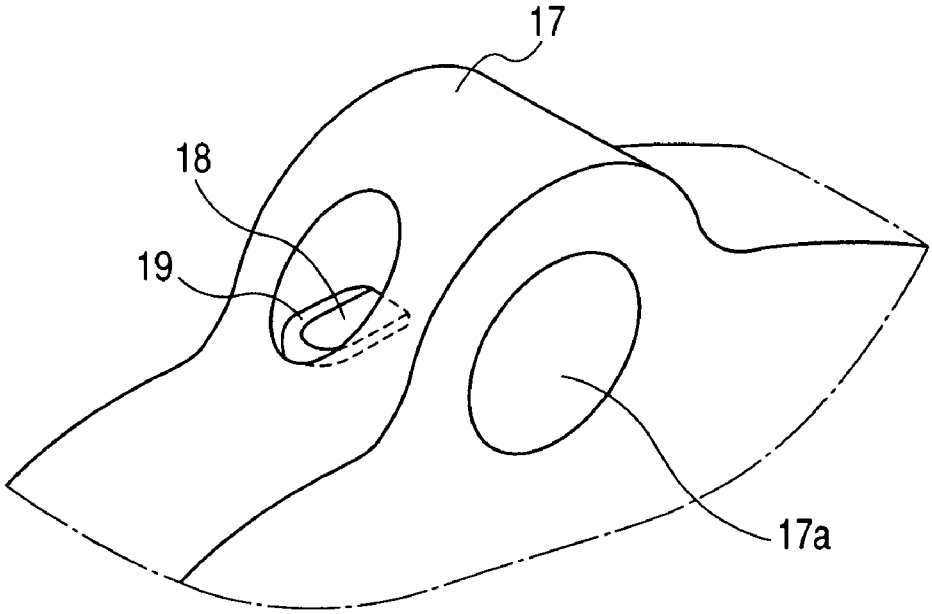
FIG. 7 is a perspective view of the bearing portion, showing the configuration of the screw seating surface.

As shown in FIGS. 4 and 6, the front bearing portion 17 also has a screw seating surface 19 provided to extend along part of the entire circumference of the retaining hole 18 for abutment with a bearing surface (of an enlarged head 13*a*) of the screw member 13 to bear a tightening force of the screw member 13. The screw seating surface 19 is formed at a position such that the head 13*a* of the screw member 13 does not project from an outer periphery of the semicircular arc-shaped front bearing portion 17, as shown in FIG. 3. The retaining hole 18 has a first side located near the center of the mounting hole 17*a* and a second side diametrically opposite to the first side and located remotely from the center of the mounting hole 17*a*. The first side of the retaining hole 18 is free from the screw seating surface 19 and passes straight through the front bearing portion 17 from the outer periphery to an inner periphery of the front bearing portion 17. As shown in FIGS. 6 and 7, the screw seating surface 19 has a substantially U-shaped configuration extending along a peripheral portion on the second side of the retaining hole 18.

Preferably, the screw seating surface 19 is formed as a result of the formation of a counter bore that is a flat-bottom enlargement of the mouth of a cylindrical bore to enlarge a borehole and gives it's a flat bottom as the screw seating surface 19.

Referring back to FIG. 1, the screw member 13 has a front end formed with an externally threaded portion 13*b* and a round shank 13*c* extending between the enlarged head 13*a* and the externally threaded portion 13*b*, the round shank 13*c* being free from screw thread. The screw member 13 is inserted in the retaining hole 18 and firmly secured to the same via threaded engagement between the internally threaded portion 18*a* of the retaining hole 18 and the externally threaded portion 13*b* of the screw member 13. The head 13*a* of the screw member 13 has a semispherical shape.

Figure 8:
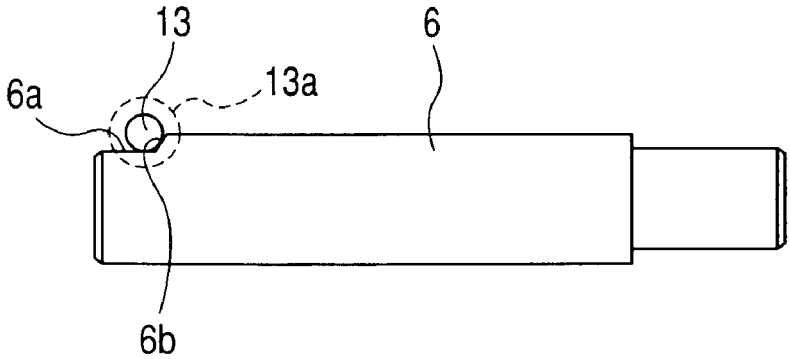
FIG. 8 is a side view of an intermediate shaft of the starter.

As shown in FIG. 8, the intermediate shaft 6 has a front end portion (left end portion in FIG. 8) formed with a flat cutout surface 6*a* and a round shoulder portion 6*b* formed between the cutout surface 6*a* and an outer circumferential surface of the intermediate shaft 6. In an assembled condition, the round shank 13*c* of the screw member 13 inserted to the retaining hole 18 retains in abutment engagement with the shoulder portion 6*b* of the intermediate shaft 6 to thereby prevent the intermediate shaft 6 from displacing off the housing 2. At the same time, the round shank 13*c* also remains in abutment with the flat cutout surface 6*a* of the intermediate shaft 6 to thereby prevent the intermediate shaft 6 from rotating relative to the housing 2.

Now, the operation of the starter 1 with the intermediate gear is described below.

Upon closing operation of a starter switch (not shown), the excitation coil of the electromagnetic switch EMSW (FIG. 2) is conducted to cause the electromagnet to attract the plunger, which is consequently moved rightward in FIG. 1. The rightward movement of the plunger is transferred to the clutch 11 via the shift lever 10. When this takes place, both the pinion gear 5 and the clutch 11 move on the pinion shaft in a direction away from the motor M. Thus, the intermediate gear 8 remains in meshing engagement with the pinion gear 5 and moves on the intermediate shaft 6 into meshing engagement with the ring gear 9 of the engine E (FIG. 3).

On the other hand, when the electromagnetic switch EMSW closes the main contacts, the motor M is supplied with electric power from the on-vehicle battery to cause the armature to generate a rotational force. The rotational force is then delivered through the reduction gear unit to the pinion shaft 3. The rotation of the pinion shaft 3 is transferred through the clutch 11 to the pinion gear 5 and further transferred to the intermediate gear 8 in meshing engagement with the pinion gear 5 at all times. Under such a condition, if the intermediate gear 8 rotates to an angular position available to mesh with the ring gear 9 of the engine E, the intermediate gear 8 is axially forced with a reaction force exerted by, for instance, a drive spring (not shown) incorporated in the electromagnetic switch EMSW into meshing engagement with the ring gear 9 of the engine E. This allows the motor M to deliver torque to the pinion gear 5 from which the torque is further transferred via the intermediate gear 8 to the ring gear 9, thereby cranking the engine E.

Upon opening operation of the starter switch after startup of the engine E, a magnetic force of the electromagnetic switch EMSW is extinguished, causing the plunger to be restored to its original position due to a reaction force of a return spring (not shown) incorporated in the electromagnetic switch EMSW. The returning force, acting on the plunger, is exerted to the clutch 11 via the shift lever 10 and both the pinion gear 5 and the clutch 11 are caused to move on the pinion shaft 3 toward the motor M. When this takes place, the intermediate gear 8 is brought out of engagement with the ring gear 9 of the engine E and moved (rightward in FIG. 1) on the intermediate shaft 8 in a direction opposite to the ring gear 9. In the meanwhile, when the electromagnetic switch EMSW is turned off to open the main contacts, the motor M is turned off, thereby stopping the rotation of the armature.

Next, various advantageous effects of the embodiment will be described below.

With the starter 1 with the intermediate gear set forth above, the screw member 13 is inserted to the retaining hole 18 of the front bearing portion 17, causing the round shank 13*c* of the screw member 13 to be brought into abutting engagement with the flat cutout surface 6 and the shoulder portion 6*b* of the intermediate shaft 6 to retain the intermediate shaft 6 in a fixed position against rotation relative to, and removal from, the housing 2. With this arrangement, since the screw member 13 can be easily attached and removed, removing the screw member 13 from the retaining hole 18 allows the intermediate shaft 6 to be removed from the housing 2. This means that when a need arises for the intermediate gear 8 to be replaced, merely removing the screw member 13 enables the intermediate shaft 6 to be taken off from the housing 2 for replacement of the intermediate gear 8. This results in a capability of providing the starter 1 with outstanding maintenance capability.

The front bearing portion 17 formed with the retaining hole 18 has a screw seating surface 19 of a substantially U-shaped configuration, which is provided not on a first side of the retaining hole 18 facing toward the center of the mounting hole 17*a*, but on a second side of the retaining hole 18 facing away from the center of the mounting hole 17, so as to extend along a peripheral portion of the retaining hole 18.

In this instance, if the screw seating surface 19 were provided also on the first side of the retaining hole 18 (namely, if the screw seating surface 19 were provided to extend along the entire circumference of the retaining hole 18), the front bearing portion 17 would have a thin part formed between the screw seating surface 19 and the inner periphery of the front bearing portion 17 on the first side of the retaining hole 18. The thus formed thin part is likely to crack or become ruptured due to stress concentration occurring when the screw member 13 is tightened or the starter 1 is activated.

According to the embodiment of the invention, however, since the first side of the retaining hole 18 is free from the screw seating surface 19 and passes straight through the front bearing portion 17 from the outer periphery to the inner periphery of the front bearing portion 17, it is possible for the front bearing portion 17 to avoid the formation of a thin part, which may otherwise cause cracking or rupturing due to stress concentration. This structural feature contributes to improvement in the durability of the starter 1.

Furthermore, since the screw seating surface 19 is formed at a position such that the head 13*a* of the screw member 13 does not project from the outer periphery of the front bearing portion 17. Thus, the head 13*a* of the screw member 13 is prevented from interfering with an engine part, as shown in FIG. 3.

With the starter 1 with the intermediate gear of the illustrated embodiment, when the intermediate gear 9 is brought into meshing engagement with the ring gear 9 and subsequently drive the ring gear 9, the intermediate shaft 6 is subject to a reaction force exerted from the ring gear 9 in a direction indicated by the arrow A shown in FIG. 1, tending to axially displace the intermediate shaft 6 off the housing 2. However, since the screw member 13 retains the intermediate shaft 6 in a fixed position against removal from the housing 2, dropping off of the intermediate shaft 6 from the housing 2 does never take place. Especially because of the thread-free round shank 13*c* of the screw member 13, which is provided between the head 13*a* and the externally threaded portion 13*b* of the screw member 13 and remains in abutting engagement with the shoulder portion 6*b* and the flat cutout surface 6*a* of the intermediate shaft 6, the intermediate shaft 6 can be retained in a fixed position in a stable manner with increased reliability.

When the intermediate gear 8 drives the ring gear 9, the intermediate shaft 6 is subjected to a reaction force exerted from the ring gear 9 in a direction indicated by the arrow B shown in FIG. 2 (on condition that the intermediate gear 8 rotates in a counterclockwise direction as indicated by the arrow a). However, since the retaining hole 18 is located on that side (right side in FIG. 2) of the central axis of the intermediate shaft 6 which is kept free from the influence of the reaction force of the ring gear 9, the screw member 13 inserted to the retaining hole 18 is not affected very much by the reaction force from the ring gear 9 and hence has a higher degree of durability.

Furthermore, since the mounting hole 17*a* formed in the front bearing portion 17 comprises a through-hole passing completely through the front bearing portion 17 in an axial direction, and the mounting hole 16*a* formed in the rear bearing portion 16 comprises a blind hole, this arrangement enables the intermediate shaft 6 to be inserted from the front side of the housing 2 for assembly with the housing 2. With this arrangement, the motor M causes no hindrance to the intermediate shaft 6 during assembly thereof, making it possible to assemble the intermediate shaft 6 to the housing 2 regardless of the presence of or absence of the motor M being assembled.

Additionally, by virtue of the retaining hole 18 formed in the front bearing portion 17 for insertion of the screw member 13, an orientation (location) of the cutout surface 6*a* formed on the intermediate shaft 6 can be easily confirmed at the front side of the housing 2 via the through-hole 17*a* formed in the front bearing portion 17. This results in a capability of inserting the screw member 13 to the retaining hole 18 while confirming location of the cutout surface 6*a* or under a positioned status, enabling work to be done with improved reliability for retaining the intermediate shaft 6 to a fixed position against removal from, and rotation relative to, the housing 2.

While one preferred embodiment has been described with reference to the structure wherein the cutout surface 6*a* and the shoulder portion 6*b* are formed on the intermediate shaft 6 at a front end thereof remote from the motor M, an alternative structure may be adopted wherein the intermediate shaft 6 is formed with a radially extending through-hole (not shown) in place of the cutout surface 6*a* and the shoulder portion 6*b*. With such structure, inserting the screw member 13 to the through-hole enables the intermediate shaft 6 to be easily retained in a fixed position against removal from, and rotation relative to, the housing 2.

Further, while in the embodiment described above the retaining hole 18 is formed in the front bearing portion 17 of the housing 2, an alternative arrangement may be possible wherein the rear bearing portion 16 is formed with the retaining hole 18 for insertion of the screw member 13, and a rear end portion of the intermediate shaft 6 is formed with a radially extending through-hole to which the screw member 13 is fitted to retain the intermediate shaft 6 in the same manner set forth above.

Although the preferred embodiment has been described in conjunction with an example wherein the intermediate shaft 6 is inserted to the mounting hole 17*a* from the front side of the housing 2 for assembly with the housing 2, another alternative may be such that the mounting hole 16*a* formed in the rear bearing portion 16 comprises a through-hole while the mounting hole 17*a* formed in the front bearing portion 17 comprises a blind hole, and the intermediate shaft 6 is inserted to the mounting hole 16*a* from the rear side (adjacent to the motor M) of the housing 2 for assembly with the housing 2.

Obviously, various minor changes and modifications are possible in the light of the above teaching. It is to be understood that within the scope of the appended claims the present invention may be practiced otherwise than as specifically described.

What is claimed is:

1. An engine starter with an intermediate gear, comprising:

a pinion shaft rotatable in receipt of a rotational force from a motor;

a pinion gear slidably supported on the pinion shaft and axially movable thereon;

an intermediate shaft disposed in parallel to the pinion shaft;

an intermediate gear rotatably supported on the intermediate shaft and axially movable thereon, the intermediate gear being adapted to remain in meshing engagement with the pinion gear at all times;

a housing which supports both end portions of the intermediate shaft; and an engagement member which retains the intermediate shaft in position against removal from the housing;

the intermediate gear being axially movable together with the pinion gear into meshing engagement with a ring gear of an engine to transfer the rotational force from the pinion gear to the ring gear via the intermediate gear for starting up the engine;

the housing having a first bearing portion which supports one end portion of the intermediate shaft and a second bearing portion which supports the other end portion of the intermediate shaft;

one of the first bearing portion and the second bearing portion having a mounting hole formed therein for insertion of the intermediate shaft, and a retaining hole formed in the one bearing portion at a position offset from a center of the mounting hole in a radial direction so as to intersect the mounting hole;

the engagement member being a screw member threaded into the retaining hole of the one bearing portion, the screw member being in engagement with the intermediate shaft to retain the intermediate shaft to the housing against removal therefrom.

2. A starter with the intermediate gear according to claim 1, wherein the housing has a mounting surface at which the housing is mounted to the engine, the first and second bearing portions of the housing have a semicircular arc shape projecting from the mounting surface of the housing toward the engine, the one bearing portion formed with the retaining hole has a screw seating surface in abutment with a bearing surface of a head of the screw member to bear a tightening force of the screw member, the screw seating surface being formed at a position such that the head of the screw member does not project from an outer periphery of the semicircular arc-shaped one bearing portion.

3. A starter with the intermediate gear according to claim 2, wherein the retaining hole has a first side located near the center of the mounting hole and a second side diametrically opposite to the first side and located remotely from the center of the mounting hole, the screw seating surface is provided to extend on the second side of the retaining hole, and the first side of the retaining hole is free from the screw seating surface and passes straight through the one bearing portion from the outer periphery to an inner periphery of the one bearing portion.

4. A starter with the intermediate gear according to claim 1, wherein the screw member has an externally threaded portion at one end thereof, an enlarged head at the other end thereof, and a round shank extending between the externally threaded portion and the head, the round shank being in engagement with the intermediate shaft to retain the intermediate shaft to the housing against removal therefrom.

5. A starter with the intermediate gear according to claim 1, wherein when the intermediate gear drives the ring gear, the intermediate shaft is subjected to a reaction force applied from the ring gear, and wherein the retaining hole is offset from the center of the mounting hole in a direction opposite to a direction of the reaction force.

6. A starter with the intermediate gear according to claim 1, wherein the first bearing portion is located adjacent to the motor and the second bearing portion is located remotely from the motor, and wherein the mounting hole formed in the first bearing portion is a blind hole and the mounting hole formed in the second bearing portion is a through-hole.

7. A starter with the intermediate gear according to claim 6, wherein the retaining hole is formed in the second bearing portion, and the intermediate shaft has a shoulder portion formed on an outer circumferential surface thereof at a position supported by the second bearing portion, the shoulder portion being engaged by the screw member to thereby prevent the intermediate shaft from displacing off from the housing.

* * * * *